US006255263B1

(12) United States Patent
Ryan

(10) Patent No.: US 6,255,263 B1
(45) Date of Patent: Jul. 3, 2001

(54) LUBRICANT COMPOSITIONS EXHIBITING IMPROVED DEMULSE PERFORMANCE

(75) Inventor: Helen T. Ryan, London (GB)

(73) Assignee: Ethyl Petroleum Additives, LTD, Bracknell (GB)

( * ) Notice: Subject to any disclaimer, the term of this patent is extended or adjusted under 35 U.S.C. 154(b) by 0 days.

(21) Appl. No.: 09/516,855

(22) Filed: Mar. 2, 2000

(30) Foreign Application Priority Data

Mar. 3, 1999 (EP) ..... 99301603

(51) Int. Cl.[7] ..... C10M 145/34; C10M 145/30
(52) U.S. Cl. ..... 508/579; 252/73; 516/191
(58) Field of Search ..... 508/579; 252/73; 516/191

(56) References Cited

U.S. PATENT DOCUMENTS 2,448,664 * 9/1948 Fife et al. .
2,615,853 * 10/1952 Kirkpatrick et al. .
2,662,859 * 12/1953 Kirkpatrick .
2,880,175 * 3/1959 Michaels et al. .
3,509,052 * 4/1970 Murphy .
4,493,776 * 1/1985 Rhodes .
5,368,765 * 11/1994 Kaneko .
5,658,865 * 8/1997 Yoshida et al. .
6,127,324 * 10/2000 Tolfa et al. .

FOREIGN PATENT DOCUMENTS 59-015489 1/1984 (JP) .
06128580 5/1994 (JP) .
9143482 6/1997 (JP) .

* cited by examiner

*Primary Examiner*—Jerry D. Johnson
(74) *Attorney, Agent, or Firm*—Thomas Hamilton; James T. Moore

(57) ABSTRACT

Hydraulic or industrial functional fluids which exhibit excellent demulse performance are prepared comprising at least one oil-soluble polyoxypropylene glycol monoalkyl ether.

15 Claims, No Drawings

LUBRICANT COMPOSITIONS EXHIBITING IMPROVED DEMULSE PERFORMANCE

BACKGROUND OF THE INVENTION

Hydraulic and industrial functional fluids are required to exhibit a number of performance characteristics and this is usually achieved by blending a base oil (stock) with a multi functional additive package. Conventional packages are designed for use in Group I base stocks. However, the number of refiners producing Group II and Group III base stocks has increased recently, and the use of these base stocks has posed a number of challenges to formulators not encountered with Group I base stocks.

Group II and III base stocks are produced by hydro processing and this reduces the aromatics content of the base stock resulting in differences in base stock solvency. Differences exist between different Group base stocks and between base stocks within the same Group. The reduced aromatics content of the base stock means that certain surface active components used in conventional hydraulic and industrial additive packages, such as demulsifiers, that function well when used in Group I base stocks do not always have sufficient solubility in all Group II and all Group III base stocks. For example, conventional demulsifiers such as copolymers of ethylene oxide and propylene oxide provide satisfactory demulse performance and are fully soluble in Group I base oils but, at useful concentrations, tend not to be fully soluble in Group II and Group III base oils. Poor demulsifier solubility results in formulated blends which are dull. Although these may be merchantable, they will also exhibit derated performance due to the presence of precipitates. The latter are particularly troublesome as precipitates can lead to clogging or blocking of the very fine filters which are typically used in, for example hydraulic apparatus, to maintain fluid cleanliness. Further, if hydraulic fluids become contaminated with such precipitates, power transmission capability can be lost and the possibility of equipment damage arises.

In accordance with the present invention a specific type of compound has been identified which provides good demulse performance and which exhibits superior solubility in the range of base oils formulators would like to use, including Group II and Group III base oils.

SUMMARY OF THE INVENTION

Accordingly, the present invention provides the use of an additive comprising an oil-soluble polyoxypropylene glycol monoalkyl ether for improving the demulse performance of a hydraulic or industrial functional fluid.

DETAILED DESCRIPTION OF THE INVENTION

By improved demulse performance is meant the ability of an oil to separate from water. The established test to evaluate the ability of hydraulic and industrial oil to separate from water is the ASTM D1401. In this test 40 ml of oil is mixed with 40 ml of water at 54° C. and the time taken for the resulting emulsion to reduce to 3 m or less is recorded. If complete separation does not occur then the volume of oil, water and emulsion present is recorded. Most hydraulic and industrial specifications require separation to 37 ml of water and 3 m of emulsion in less than 30 minutes.

Typically, the polyoxypropylene glycol monoalkyl ether has a number average molecular weight of 2000 to 5000, 3000 to 6000, preferably from 3500 to 4500 and, more preferably of about 4100. preferred embodiment of the invention, the alkyl moiety of this component is n-butyl.

In terms of physical properties, the ether component typically has a viscosity at 40° C. of about 360to 410 cSt. In a preferred embodiment the viscosity of the component is about 400 cSt at 40 ° C. and about 50 cSt at 100° C. The component usually has a pour point of −15 to 31 35° C. preferably about −22° C. Useful polyoxypropylene glycol monoalkyl ethers are commercially available or may be made by the application or adaptation of known techniques.

The ether component is typically employed in an amount of 0.5% to 4.0 wt %, preferably 1 to 3 wt % and more preferably 2.0 wt % based on the weight of the fully formulated fluid.

In a preferred embodiment of the invention the polyoxypropylene ether described is used in combination with a copolymer of ethylene oxide and propylene oxide. Such a combination is capable of providing even better demulse performance without detriment to the cleanliness of the composition (as may be assessed by the clarity and brightness of the finished fluid and by the Afnor wet filtrability test using a 0.8 micron filter). When this combination is employed the amount of the copolymer of ethylene oxide and propylene oxide required to give effective demulse performance is significantly reduced which allows for formulation of clear and bright finished lubricants when using either Group I, II or III base stocks. Typically, the copolymer has a mole ratio of units derived from ethylene oxide to units derived from propylene oxide of 2.0:1 to 0.3:1, preferably 0.65:1. In a preferred embodiment the copolymer has a number average molecular weight of 2000 to 4500, preferably 3800. When this combination is employed the weight ratio of the polyoxypropylene glycol monoalkyl ether to copolymer is 60:1 to 10:1, preferably about 20:1.

Base oils contemplated for use in this invention include natural oils, synthetic oils and mixtures thereof. Suitable oils also include base stocks obtained by isomerization of synthetic wax and slack wax, as well as base stocks produced by hydro cracking (rather than solvent extracting) the aromatic and polar components of crude oil. In general, both the natural and synthetic oils will each have a kinematic viscosity ranging from about $1\times10^{-6}$ $m^2/s$ to about $40\times10^{-6}$ $m^2/s$ (about 1 to about 40 cSt) at 100° C., although typical applications will require each oil to have a viscosity ranging from about $2\times10^{-6}$ $m^2/s$ to about $8\times10^{-6}$ $m^2/s$ (about 2 to about 8 cSt) at 100° C.

Natural base oils include animal oils, vegetable oils (e.g., castor oil and lard oil), petroleum oils, mineral oils, and oils derived from coal or shale. The preferred natural base oil is mineral oil.

The mineral oils useful in this invention include all common mineral oil base stocks. This would include oils that are naphthenic or paraffinic in chemical structure. Oils that are refined by conventional methodology using acid, alkali, and clay or other agents such as aluminum chloride, or they may be extracted oils produced, for example, by solvent extraction with solvents such as phenol, sulfur dioxide, furfural, dichlorodiethyl ether, etc. They may be hydro treated or hydro-refined, dewaxed by chilling or catalytic dewaxing processes, or hydro cracked. The mineral oil may be produced from natural crude sources or be composed of isomerized wax materials or residues of other refining processes.

Typically the mineral oils will have kinematic viscosities of from $2\times10^{-6}$ $m^2/s$ to $12\times10^{31\ 6}$ $m^2/s$ (2 cSt to 12 cSt) at 100° C. The preferred mineral oils have kinematic viscosities of from $3\times10^{-6}$ $m^2/s$ to $10\times10^{-6}$ $m^2/s$ (3 to 10 cSt), and most preferred are those mineral oils viscosities of $5\times10^{-6}$ $m^2/s$ to $9\times10^{-6}$ $m^2/s$ (5 to 9 cSt) at 100° C.

Synthetic oils useful in this invention include hydrocarbon oils and halo-substituted hydrocarbon oils such as oligomerized, polymerized, and interpolymerized olefins [e.g., polybutylenes, polypropylenes, propylene, isobutylene copolymers, chlorinated polylactenes, poly(1-hexenes), poly (1-octenes), and mixtures thereof]; alkylbenzenes [e.g., polybutylenes, polypropylenes, propylene, isobutylene copolymers, chlorinated polylactenes, poly(1-hexenes), poly (1-octenes) and mixtures thereof]; alkylbenzenes [e.g., dodecyl-benzenes, tetradecylbenzenes, dinonyl-benzenes and di(2-ethylhexyl)benzene]; polyphenyls [e.g., biphenyls, terphenyls, alkylated polyphenyls]; and alkylated diphenyl ethers, alkylated diphenyl sulfides, as well as their derivatives, analogs, and homologs thereof, and the like. The preferred synthetic oils are oligomers of -olefins, particularly oligomers of 1-decene, also known as polyalpha olefins or PAO's.

Synthetic oils also include alkylene oxide polymers, interpolymers, copolymers, and derivatives thereof where the terminal hydroxyl groups have been modified by esterification or etherification. This class of synthetic oils is exemplified by: polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polypropylene glycol having a molecular weight of 100–1500); and mono- and poly-carboxylic esters thereof (e.g., the acetic acid esters, mixed $C_3$–$C_8$ fatty acid esters, and $C_{12}$ oxo acid diester of tetraethylene glycol).

Another suitable class of synthetic oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkylmalonic acids and alkenyl malonic acids) with a variety of alcohols (e.g., butyl alcohol, hexyl alcohol, dodecyl alcohol, 2-ethylhexyl alcohol, ethylene glycol, diethylene glycol monoethers and propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl isophthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethyl-hexanoic acid. A preferred type of oil from this class of synthetic oils are adipates of $C_4$ to $C_{12}$ alcohols.

Esters useful as synthetic oils also include those made from $C_5$ to $C_{12}$ monocarboxylic acids and polyols and polyol ethers such as neopentyl glycol, trimethylolpropane pentaerythritol, dipentaerythritol and tripentaerythritol.

Silicon-based oils (such as the polyalkyl-, polyaryl-, polyalkoxy-, or polyaryloxy-siloxane oils and silicate oils) comprise another useful class of synthetic lubricating oils. These oils include tetra-ethyl silicate, tetraisopropyl silicate, tetra-(2-ethylhexyl) silicate, tetra-(4-methyl-2-ethylhexyl) silicate, tetra-(p-tert-butylphenyl) silicate, hexa-(4-methyl-2-pentoxy)-disiloxane, poly(dimethyl)-siloxanes and poly (methylphenyl) siloxanes. Other synthetic lubricating oils include liquid esters of phosphorus containing acids (e.g., tricresyl phosphate, trioctylphosphate, and diethyl ester of decylphosphonic acid), polymeric tetra-hydrofurans and poly-olefins.

The base oils may be derived from refined, re-refined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydro treating, dewaxing, solvent extraction, acid or base extraction, filtration, and percolation, all of which are known to those skilled in the art. Re-refined oils are obtained by treating used oils in processes similar to those used to obtain the refined oils. These re-refined oils are also known as reclaimed or reprocessed oils and are often additionally processed by techniques for removal of spent additives and oils breakdown products. White oils, as taught in U.S. Pat. No. 5,736,490 may also be used as the base oil, especially for turbine applications.

In an embodiment of the invention the base oil is a Group I, Group II, Group III or Group IV base oil. The use of Group II or Group III base oils is preferred.

The American Petroleum Institute has categorized these different base stock types as follows: Group I, >0.03 wt % sulfur, and/or <90 vol % saturates, viscosity index between 80 and 120; Group II, 0.03 wt % sulfur, and 90 vol % saturates, viscosity index between 80 and 120; Group III, 0.03 wt % sulfur, and 90 vol % saturates, viscosity index >120; Group IV, all polyalphaolefins. Hydrotreated base stocks and catalytically dewaxed base stocks, because of their low sulfur and aromatics content, generally fall into the Group II and Group III categories. Polyalphaolefins (Group IV base stocks) are synthetic base oils prepared from various alpha olefins and are substantially free of sulfur and aromatics.

The functional fluids may be prepared by simple blending of the various components with a suitable base oil.

For the sake of convenience, and in another embodiment of the present invention, the additive components used in practice of this invention may be provided as a concentrate for formulation into a functional fluid ready for use.

The concentrate may comprise, in addition to the fluid components, a solvent or diluent for the fluid components. The solvent or diluent should be miscible with and/or capable of dissolving in the base oil to which the concentrate is to be added. Suitable solvents and diluents are well known. The solvent or diluent may be the base oil of the functional fluid itself. The concentrate may suitably include any of the conventional additives used in hydraulic and industrial applications. The proportions of each component in the concentrate are controlled by the intended degree of dilution, though top treatment of the formulated fluid is possible.

Other additives commonly used in fluids for hydraulic and industrial applications may be included in the compositions or concentrates of the present invention. These include antioxidants, dispersants, friction modifiers, detergents, anti-wear and/or extreme pressure agents, rust inhibitors and corrosion inhibitors. These additives, when present, are used in amounts conventionally used in such applications. Some additives may be included in the concentrate and some added to the fully formulated fluid as a top-treat.

An embodiment of the present invention is directed to a hydraulic or industrial fluid comprising a base oil; at least one oil soluble polyoxypropylene glycol monoalkyl ether; and at least one copolymer of ethylene oxide and propylene oxide.

In another embodiment, the present invention is directed to an improved hydraulic or industrial fluid comprising A) a base oil and B) at least one demulsifier, wherein said improvement comprises using as a demulsifier for said hydraulic or industrial fluid a polyoxypropylene glycol monoalkyl ether.

Examples of hydraulic and industrial applications where the present invention may be employed include hydraulic oils, turbine (R&O) oil, compressor oils, slideway oils, paper machine oils.

The following examples illustrate the present invention.

EXAMPLE 1

A functional fluid was prepared by blending an additive package comprising the components listed below with a base stock. The treat rate of the additive package was 0.85%.

| | |
|---|---|
| Rust Inhibitor | 6.00 wt % |
| Antioxidants | 23.00 wt % |
| Process oil | 1.120 wt % |
| Antiwear and/or extreme pressure agent | 60.00 wt % |
| Demulsifier | 2.00 wt % |

The demulsifier was a polyoxypropylene glycol monoalkyl ether having a weight average molecular weight of about 4100.

The formulated fluid was then subjected to the ASTM D1401 demulse test and the wet filtrability of each fluid was assessed using Afnor E48-691 (wet) test. In the latter, a water-treated fluid is filtered under conditions of constant pressure and temperature through a membrane with a determined absolute stopping power.

The filtrability index of the fluid IF is defined for a given fluid by the ratio:

$$IF=\frac{T\,300-T\,200}{2(T100-T50)}$$

in which $T_{300}$ is the passage time, through the membrane, of 300 $cm^3$ of fluid.

$T_{200}$ is the passage time, through the membrane, of 200 $cm^3$ of fluid.

$T_{100}$ is the passage time, through the membrane, of 100 $cm^3$ of fluid.

$T_{50}$ is the passage time, through the membrane, of 50 $cm^3$ of fluid.

The IF ratio therefore consists of comparing the filtration speeds of the fluid in the course of the test. The ratio as well as the filtration speed of the various segments for each sample are indicative of the ease of filtration of the fluid. An IF value of less than 1 indicates a fault in the test method. The closer the IF value to 1, the better filtrability of the fluid. If during testing the membrane becomes clogged an abort result is recorded. The results are shown in the following table which also identifies the kind of base oil used in formulating the fluid.

TABLE 1

| | Base Oil (Group) | | | |
|---|---|---|---|---|
| | BP ISO 32 (Group I) | Petrocanada SPC 35LT (Group II) | Excel ISO 32 (Group II) | Yubase 6 (Group III) |
| D1401 | | | | |
| Time to 37 ml water | 11 | 13.04 | 9.40 | 16.42 |
| Time to 3 ml emulsion | 11 | 13.04 | 9.40 | 16.42 |
| Result at 30 minutes | 40/39/1 | 40/40/0 | 40/40/0 | 40/39/1 |
| Afnor Dry | 1.09 | — | — | 1.18 |
| Afnor Wet | 1.34 | — | — | 1.62 |

These results demonstrate that the polyoxypropylene glycol monoalkyl ether used in accordance with the present invention enables satisfactory demulse and filtrability when used in a variety of base stocks. It is noteworthy that acceptable results are obtained even when Group II and Group III base stocks are used.

EXAMPLE 2

Additive packages A and B were prepared containing the following components.

| | A (wt %) | B (wt %) |
|---|---|---|
| Detergents | 7.88 | 7.88 |
| Rust Inhibitor | 6 | 6 |
| Antioxidants | 23.00 | 23.00 |
| Demulsifier[1] | 0.75 | 0.1 |
| Demulsifier[2] | — | 2 |
| Process oil | 1.02 | 1.02 |
| Antiwear and/or extreme pressure agent | 60.00 | 60.00 |

[1]Copolymer of ethylene oxide and propylene oxide.
[2]A polyoxyproplene glycol monoalkyl ether having a number average molecular weight of about 4100.

Functional fluids were then formulated by blending each additive package at a treat rate of 0.85% with various base stocks. Each fluid was then subjected to the ASTM D1401 demulse test and to the Afnor filtrability test. The appearance of each fluid was also assessed visually. The results are shown in the following table which also identifies the kind of base stock used.

TABLE 2

| Base oil (Group) Additive | ESSO ISO 46 (Group I) | | Mobil Jurong 32 (Group II) | | Yubase 6 (Group III) | |
|---|---|---|---|---|---|---|
| Package | A | B | A | B | A | B |
| D1401 | | | | | | |
| Time to 37 ml water | 22.07 | 7.50 | 11.15 | 5.26 | 15.17 | 5.88 |
| Time to 3 ml emulsion | 22.07 | 9.25 | 11.15 | 5.26 | 15.17 | 5.88 |
| Time to 40/40/0 separation | 22 | 9.25 | 11 | 5.26 | 17.09 | 11.42 |
| Appearance | Clear and | Clear and | Dull (precipitate | Clear and | Dull (precipitate | Clear and |

TABLE 2-continued

| Base oil (Group) Additive | ESSO ISO 46 (Group I) | | Mobil Jurong 32 (Group II) | | Yubase 6 (Group III) | |
|---|---|---|---|---|---|---|
| Package | A | B | A | B | A | B |
| | bright | bright | after time) | bright | after time) | bright |
| Afnor Dry | 1.19 | 1.09 | 1.15 | 1.10 | 16.14 | 1.14 |
| Afnor Wet | 1.13 | 1.21 | 1.32 | 1.44 | 2.4 | 2.08 |

These results demonstrate that use of a polyoxypropylene glycol monoalkyl ether in combination with a relatively low concentrate of ethylene oxide/propylene oxide copolymer leads to satisfactory results in all base stock types. In particular it should be noted that addition of the ether compound leads to improved appearance when the combination is used in the Group II and Group III base stocks. When additive package A is used in these base stocks a dull appearance is observed, and a precipitate forms after aging. In contrast, when additive package B is used in the same base stocks, the appearance of the formulation was clear and bright without precipitation after aging. Addition of the ether also gave significant improvements in demulse performance and, with one exception, Afnor filtrability.

EXAMPLE 3

Rust and oxidation turbine oils were prepared by blending additive package C and D, comprising the components listed below, with a base stock. The treat rate was 0.8% wt.

Additive packages C and D were prepared containing the following components.

| | C (wt %) | D (wt %) |
|---|---|---|
| Antioxidant | 60 | 60 |
| Rust Inhibitor | 15 | 15 |
| Corrosion Inhibitor | 3 | 3 |
| Demulsifier[1] | 0.025 | 0.025 |
| Demulsifier[2] | — | 2 |

[1]Copolymer of ethylene oxide and propylene oxide.
[2]A polyoxypropylene glycol monoalkyl ether having a number average molecular weight of about 4100.

Each formulated oil was then subjected to the ASTM D1401 demulse test. The results are shown in the following table which also identifies the kind of base stock used.

higher levels of the copolymer of ethylene oxide/propylene oxide was found to improve demulse performance in the D1401 test but led to dull blends when formulating with the Group II and Group III base stocks.

This invention is susceptible to considerable variation in its practice. Accordingly, this invention is not limited to the specific exemplifications set forth hereinabove. Rather, this invention is within the spirit and scope of the appended claims, including the equivalents thereof available as a matter of law.

The patentee does not intend to dedicate any disclosed embodiments to the public, and to the extent any disclosed modifications or alterations may not literally fall within the scope of the claims, they are considered to be part of the invention under the doctrine of equivalents.

I claim:

1. A method for demulsifying a hydraulic or industrial fluid, said method comprises adding to a base oil used for preparing said hydraulic or industrial functional fluid a mixture of an oil-soluble polyoxypropylene glycol monoalkyl ether and a copolymer of ethylene oxide and propylene oxide, wherein the weight ratio of the polyoxypropylene glycol monoalkyl ether to said copolymer is 60:1 to 10:1.

2. The method of claim 1 wherein the base oil for preparing said hydraulic or industrial functional fluid is a Group I, Group II, Group III or Group IV base oil.

3. The method of claim 2 wherein the base oil is a Group II or group III base oil.

4. The method of claim 2 wherein the polyoxypropylene glycol monoalkyl ether has a number average molecular weight of 2000 to 5000.

5. The method of claim 4 wherein the polyoxypropylene glycol monoalkyl ether has a number average molecular weight of about 4100.

6. The method of claim 1 wherein the alkyl moiety of the monoether is n-butyl.

7. The method of claim 1 wherein the polyoxypropylene glycol monoalkyl ether is present in an amount of 0.5 to 4.0 wt % based on the total weight of the fluid.

8. The method of claim 1 wherein in the copolymer the mole ratio of units derived from ethylene oxide to units derived from propylene oxide is 0.65:1.

9. The method of claim 8 wherein the copolymer has a number average molecular weight of 2000 to 4500.

10. The method of claim 1 wherein the weight ratio of the polyoxypropylene glycol monoalkyl ether to copolymer is about 20:1.

TABLE 3

| | Base oil (Group) | | | | | | | |
|---|---|---|---|---|---|---|---|---|
| | ESSO ISO 46 (Gr. I) | | ESSO ISO 68 (Gr. I) | | RLOP ISO 32 (Gr. II) | | ALOR ISO 68 (Gr. I) | |
| Additive Package | C | D | C | D | C | D | C | D |
| D1401 | | | | | | | | |
| Time to 37 ml water | 23.28 | 9.27 | 28.47 | 10.55 | 17.08 | 2.32 | 33.1 | 15.42 |
| Time to 3 ml emulsion | 23.28 | 9.27 | 28.47 | 10.55 | 17.08 | 2.32 | 33.1 | 15.42 |
| Result at 30 minutes | 41/39/0 | 41/39/0 | 40/39/1 | 41/39/0 | 40/40/0 | 40/40/0 | 38/32/10 | 41/39/0 |

The results demonstrate that addition of the polyoxypropylene glycol monoalkyl ether provides improved demulse performance in all of the base stocks tested without leading to dull blends in Group II and Group III base stocks. Use of

11. A hydraulic or industrial fluid comprising:

A) a base oil;

B) at least one oil soluble polyoxypropylene glycol monoalkyl ether; and

C) at least one copolymer of ethylene oxide and propylene oxide; wherein the weight ratio of the polyoxypropylene glycol monoalkyl ether (B) to said copolymer (C) is 60:1 to 10:1.

12. The hydraulic or industrial fluid of claim 11 wherein the polyoxypropylene glycol monoalkyl ether has a number average molecular weight of 2000 to 5000.

13. The hydraulic or industrial fluid of claim 12 wherein the polyoxypropylene glycol monoalkyl ether has a number average molecular weight of approximately 4100.

14. An improved hydraulic or industrial fluid comprising A) a base oil and B) at least one demulsifier, wherein said improvement comprises using as a demulsifier for said hydraulic or industrial fluid a mixture of a polyoxypropylene glycol monoalkyl ether and a copolymer of ethylene oxide and propylene oxide, and wherein the weight ratio of the polyoxypropylene glycol monoalkyl ether to said copolymer is 60:1 to 10:1.

15. The improved hydraulic or industrial fluid of claim 14 wherein the polyoxypropylene glycol monoalkyl ether has a number average molecular weight of 2000 to 5000.

* * * * *